US006006567A

United States Patent [19]

Brown et al.

[11] Patent Number: 6,006,567

[45] Date of Patent: Dec. 28, 1999

[54] APPARATUS AND METHOD FOR HYDROFORMING

[76] Inventors: James H. Brown, 30519 Louise, Westland, Mich. 48185; Gary A. Webb, 1875 Windside, West Bloomfield, Mich. 43324

[21] Appl. No.: 08/856,511

[22] Filed: May 15, 1997

[51] Int. Cl.[6] ..... B21D 9/15; B21D 26/02

[52] U.S. Cl. ..... 72/58; 72/57; 72/62

[58] Field of Search ..... 72/56, 58, 60, 72/62

[56] References Cited

U.S. PATENT DOCUMENTS

| | | | |
|---|---|---|---|
| Re. 33,990 | 7/1992 | Cudini | 83/367 |
| 169,392 | 11/1875 | Wicks . | |
| 453,410 | 6/1891 | Langerfeld . | |
| 519,593 | 4/1894 | Kirke . | |
| 523,948 | 7/1940 | Kirke . | |
| 567,518 | 9/1896 | Simmons . | |
| 588,804 | 8/1897 | Parish . | |
| 618,353 | 1/1899 | Huber . | |
| 693,172 | 2/1902 | Sneddon . | |

(List continued on next page.)

FOREIGN PATENT DOCUMENTS

| | | | |
|---|---|---|---|
| (C) 1309239 | 10/1992 | Canada | 26/182 |
| 374317 | 7/1907 | France . | |
| 0154228 | 11/1981 | Japan . | |
| 56-154228 | 11/1981 | Japan . | |
| 58-3788 | 1/1983 | Japan . | |
| 59-130633 | 7/1984 | Japan . | |
| 60-82229 | 5/1985 | Japan . | |
| 05327490 | 12/1993 | Japan . | |
| 549199 | 7/1977 | U.S.S.R. . | |
| 2162446 | 2/1986 | United Kingdom . | |

*Primary Examiner*—David Jones
*Attorney, Agent, or Firm*—Arnold White & Durkee

[57] ABSTRACT

A apparatus and method for forming a complex-shaped frame member from a blank tube having opposed ends is provided. The blank tube is placed in a first cavity on a lower die. An upper die is lowered from an open position to a close proximity to the lower die. The upper die has a second cavity aligned with the first cavity. A pair of sealing units seal the opposing ends of the blank tube, and a fluid delivery means for communicates a fluid into the tube. A fluid control means pressurizes the fluid in the tube to a low pressure level. A position determining means determines a distance separating the upper die in the closed position from said lower die in the lowered position. A lower die lifting means raises the lower die from the lowered position the determined distance to the lifted position. The fluid control means then pressurizes the fluid in the tube to expand the tube to conform to the forming cavity.

55 Claims, 8 Drawing Sheets

U.S. PATENT DOCUMENTS

| | | | |
|---|---|---|---|
| 731,124 | 6/1903 | Park . | |
| 1,210,629 | 1/1917 | Foser . | |
| 1,389,348 | 8/1921 | Gulick . | |
| 1,448,457 | 3/1923 | Liddell . | |
| 1,542,983 | 6/1925 | Bergmann, Jr. . | |
| 1,683,123 | 9/1928 | Bergmann, Jr. . | |
| 1,879,009 | 9/1932 | Anthony . | |
| 1,884,589 | 10/1932 | Davies . | |
| 2,203,868 | 6/1940 | Gray et al. | 113/44 |
| 2,652,121 | 9/1953 | Kearns, Jr. et al. | 170/159 |
| 2,707,820 | 5/1955 | Reynolds | 29/421 |
| 2,713,314 | 7/1955 | Leuthesser et al. | 113/44 |
| 2,734,473 | 2/1956 | Reynolds | 113/44 |
| 2,748,455 | 6/1956 | Draper et al. | 29/157.6 |
| 2,777,500 | 1/1957 | Ekholm et al. | 153/40 |
| 2,841,865 | 7/1958 | Jackson | 29/421 |
| 2,892,254 | 6/1959 | Garvin | 29/421 |
| 2,902,962 | 9/1959 | Garvin | 113/44 |
| 3,072,085 | 1/1963 | Landis | 113/44 |
| 3,077,170 | 2/1963 | Parlasca | 113/33 |
| 3,105,537 | 10/1963 | Foster | 153/39 |
| 3,136,053 | 6/1964 | Powell | 29/544 |
| 3,151,590 | 10/1964 | Garvin | 113/44 |
| 3,160,130 | 12/1964 | Pesak | 113/44 |
| 3,220,098 | 11/1965 | Arbogast | 29/157 |
| 3,247,581 | 4/1966 | Pellizzari | 29/157 |
| 3,303,680 | 2/1967 | Thielsch | 72/58 |
| 3,328,996 | 7/1967 | Pin et al. | 72/301 |
| 3,487,668 | 1/1970 | Fuchs, Jr. | 72/55 |
| 3,505,846 | 4/1970 | Smida | 72/61 |
| 3,535,901 | 10/1970 | Tominaga | 72/61 |
| 3,550,491 | 12/1970 | Wingard | 83/22 |
| 3,613,423 | 10/1971 | Nakamura | 72/58 |
| 3,654,785 | 4/1972 | Ueda et al. | 72/28 |
| 3,701,270 | 10/1972 | Matthews | 72/57 |
| 3,739,615 | 6/1973 | Tressel | 72/57 |
| 3,763,681 | 10/1973 | Flintoft | 72/57 |
| 3,768,288 | 10/1973 | Jury | 72/61 |
| 3,808,860 | 5/1974 | Yamaguchi et al. | 72/60 |
| 3,813,751 | 6/1974 | Smida | 29/202 |
| 3,946,584 | 3/1976 | Yamasaki | 72/60 |
| 3,974,675 | 8/1976 | Tominaga | 72/56 |
| 4,125,937 | 11/1978 | Brown et al. | 29/727 |
| 4,189,162 | 2/1980 | Rasmussen et al. | 279/4 |
| 4,238,878 | 12/1980 | Stamm et al. | 29/421 R |
| 4,319,471 | 3/1982 | Benteler et al. | 72/59 |
| 4,484,756 | 11/1984 | Takamiya et al. | 280/281 R |
| 4,485,653 | 12/1984 | Rasmussen | 72/58 |
| 4,485,654 | 12/1984 | Rasmussen | 72/58 |
| 4,567,743 | 2/1986 | Cudini | 72/61 |
| 4,704,886 | 11/1987 | Evert et al. | 72/57 |
| 4,730,474 | 3/1988 | Iwakura et al. | 72/61 |
| 4,744,237 | 5/1988 | Cudini | 72/367 |
| 4,759,111 | 7/1988 | Cudini . | |
| 4,761,982 | 8/1988 | Snyder | 72/58 |
| 4,788,843 | 12/1988 | Seamann et al. | 72/58 |
| 4,803,878 | 2/1989 | Moroney | 72/296 |
| 4,815,308 | 3/1989 | Moroney | 72/296 |
| 4,827,747 | 5/1989 | Okada et al. | 72/59 |
| 4,829,803 | 5/1989 | Cudini | 72/367 |
| 4,840,053 | 6/1989 | Nakamura | 72/58 |
| 5,070,717 | 12/1991 | Boyd et al. | 72/58 |
| 5,107,693 | 4/1992 | Olszewski et al. | 72/58 |
| 5,170,557 | 12/1992 | Rigsby | 29/890.08 |
| 5,203,190 | 4/1993 | Kramer et al. | 72/62 |
| 5,233,854 | 8/1993 | Bowman et al. | 72/58 |
| 5,233,856 | 8/1993 | Shimanovski et al. | 72/62 |
| 5,235,836 | 8/1993 | Klages et al. | 72/62 |
| 5,239,852 | 8/1993 | Roper | 72/58 |
| 5,279,142 | 1/1994 | Kaiser | 72/61 |
| 5,321,964 | 6/1994 | Shimanovski et al. | 72/62 |
| 5,333,775 | 8/1994 | Bruggemann et al. | 228/157 |
| 5,339,667 | 8/1994 | Shah et al. | 72/58 |
| 5,353,618 | 10/1994 | Roper et al. | 72/58 |
| 5,363,544 | 11/1994 | Wells et al. | 29/523 |
| 5,481,892 | 1/1996 | Roper et al. | 72/62 |
| 5,499,520 | 3/1996 | Roper | 72/58 |
| 5,715,718 | 2/1998 | Rigsby et al. | 72/58 |

APPARATUS AND METHOD FOR HYDROFORMING

BACKGROUND OF THE INVENTION

1. Field of the Invention

The present invention relates generally to the field of cold forming tubular materials and, more particularly, to an apparatus and method for hydroforming a complex-shape frame from a blank tube.

2. Description of the Related Art

Industry requires standard blank tubes to be formed into one-piece, complex tubular shapes. In the automobile industry, automobile frames are typically of the "box" type construction for strength and load bearing purposes. These frame members often have a great variation in both the horizontal and vertical profile. The cross-section of such members often varies rather extremely from approximately a square cross-section, to a rectangular cross-section to a round cross-section to a severely flattened cross-section, and to any irregularly shaped combination of the above. The same is true for the antenna industry, which requires a wide variety of cross-section shapes for waveguides.

The general operations of bending, stretching, depressing and radially expanding a tube blank, with or without a mandrel, are known. For the majority of metals, it is fairly easy to bend small diameter tubing into an arc having a large radius. But as the diameter of the tubing increases and the radius about which it is to be bent decreases, the tube bending process requires some combination of compression at the inner bending radius of the tube and stretching at the outer radius. Although the outer bending surface of the tube may be stretched to the full extent of the materials rated elongation characteristics, a tube with a given diameter cannot be satisfactorily bent about a relatively small bending radius without encountering severe buckling at the inner bending surface or undesirable deformation at the outer bending radius. Some have achieved bending tubes with a certain diameter about relatively small bending radii by controllably dimpling or allowing controlled rippling of the inner tube surface thereby creating less stretching of the outer tube surface.

A standard mechanical press is one device used to shape blank tubes. FIG. 1*a* and 1*b* illustrate the standard mechanical press 10. The mechanical press 10 has a stationary lower die 12 supported by a fixed lower die bed 16. As shown in FIG. 1*b*, a blank tube 20 is placed into the cavity in the lower die 12. To shape the blank tube 20, an upper die 14 moves downward propelled by a ram press 18. The ram press 18 provides a force necessary to compress the blank tube 12 between the contacting lower and upper dies 12 and 14. The main problem with using a mechanical press to shape a blank tube 20 is that the depressed tube will not be pushed into the deep recesses of the cavity, especially for complex shapes. Since the depressed tube does not fill the recesses of the cavity, the shaped tube does not conform to the desired shape provided by the cavity between the lower and upper dies 14 and 20.

An apparatus that forms complex tubular shapes is a hydroforming press. The hydroforming press follows a series of steps to form the desired tubular shape. Generally, a tube or workpiece is placed between a pair of dies having cavities which defined the desired resultant shape of the tube. The dies merge, and the ends of the workpiece are sealed with a pair of sealing units. The workpiece is filled with fluid which is then pressurized. Pressurizing the fluid within the workpiece results in forming and expanding the tube to conform to the cavity shape. The fluid is drained from the tube and the sealing units are removed to release the workpiece. The main problem with the hydroforming press is its extreme cost. A single hydroforming press can cost approximately three million dollars.

Since mechanical presses are widely available and have been in service in many factories for years, attempts have been made to modify the mechanical presses to perform the above hydroforming operation. In transforming a standard mechanical press into a hydroforming press, sealing units must be added to seal the ends of the blank tube. The ram press lowers and stops the upper die at its lowered position. The sealing units supply the blank tube with a forming fluid which is then pressurized. Pressurizing the forming fluid within the blank tube forms and expands the blank tube to conform to the cavity shape. After the shaped tube is formed, the forming fluid is drained from the tube and the sealing units are removed to release the formed tube The main problem with the mechanical press turned hydroformer is that when the upper die is lowered and stopped, the upper die does not contact the lower die to close the cavity between the dies. The ram press follows an elliptical path downward on its journey to have the upper die contact the lower die. Because the lower die is fixed, the ram press must stop its motion exactly when the two dies contact. However, the tolerance on a standard mechanical press leaves the ram press stopping at plus or minus five degrees from its one hundred and eighty degree point in which the dies would be in closed contact. Since the dies are unlikely to be completely closed when the tube is pressurized, the tube expanding under internal pressure to fill the deep recesses of the cavity also pinches between the mating dies. The end product from the transformed mechanical is an ill formed tube with the tube having ribs conforming to the space between the two non-contacting dies.

The present invention is directed to overcoming or at least reducing the effects of, one or more of the problems set forth above.

SUMMARY OF THE INVENTION

In accordance with one aspect of the present invention, there is provided a hydroforming method for forming a complex-shaped frame member from a blank tube comprising the following step. The blank tube is placed into a first cavity in a lower die and an upper die is lowered from an open position to a close proximity to the lower die. The upper die has a second cavity aligned with said first cavity. The opposed ends of the blank tube are sealed with a pair of sealing units and a forming fluid is communicated into the sealed blank tube. The forming fluid in the blank tube is internally pressurized to a low level to prevent the tube from collapsing between the lower and upper die. The lower die is raised such that the upper die and the lower die mate joining the first and second cavities into a forming cavity that encloses the blank tube. The blank tube is further internally pressurized to expand the blank tube such that it conforms to the forming cavity. After the expanded tube is formed, the forming fluid is drained from the tube and the sealing units retract away from the ends of the tube. The lower and upper dies release the formed tube whose ends are cropped to form the finished complex-shaped frame member.

In accordance with another aspect of the present invention, there is provided an apparatus for forming a complex-shaped frame member from a blank tube. The hydro-tube forming apparatus comprising a lower die and an upper die. The lower die is capable of moving between an lowered position and a lifted position. The lower die has a first cavity capable of receiving the blank tube. An upper die, capable of moving between an open position to a close proximity to the lower die, has a second cavity aligned with the first cavity. A pair of sealing units are capable of moving between a retracted position and a sealed position. The sealing units are positioned away from the opposed ends of the blank tube in the retracted position, and the sealing units seal the opposed ends of the blank tube in the sealed position. A fluid delivery means capable of filling the blank tube with a forming fluid when the sealing units are in the sealed position. A lower die lifting means capable of raising said lower die from the lowered position to the lifted position such that said upper die and said lower die mate joining the first and second cavity into a forming cavity. A fluid control means for pressurizing the forming fluid in the sealed blank tube to expand the blank tube to conform to the forming cavity.

In accordance with a further aspect of the present invention, there is provided an improved mechanical press for shaping a blank tube with opposed ends. The mechanical press is of the type containing a lower die having a lower die cavity capable of receiving a blank tube, a ram press, an upper die mounted on said ram press. The upper die is moveable between and open and a close proximity to the lower die. The upper die has a upper die cavity aligned with the lower die cavity. The improvement to the mechanical press comprises a pair of sealing units, a lower die lifting means, and a fluid control means. The sealing units are moveable between a retracted position and a sealed position. In the retracted position the sealing units are positioned away from the ends of the tube. In the sealed position, the sealing units sealably engaging said ends of said tube. A fluid delivery means is also provided to introduce a forming fluid into the sealed tube. A position determining means determines a distance separating the upper die and lower die. The lower die lifting means raises the lower die the determined distance to join the upper die cavity and the lower die cavity to form a forming cavity. A fluid control means pressurizes the forming fluid in the tube to expand the tube such that it conforms to the forming cavity.

BRIEF DESCRIPTION OF THE DRAWINGS

The foregoing and other advantages of the invention will become apparent upon reading the following detailed description and upon reference to the drawings which.

Figure 1A:
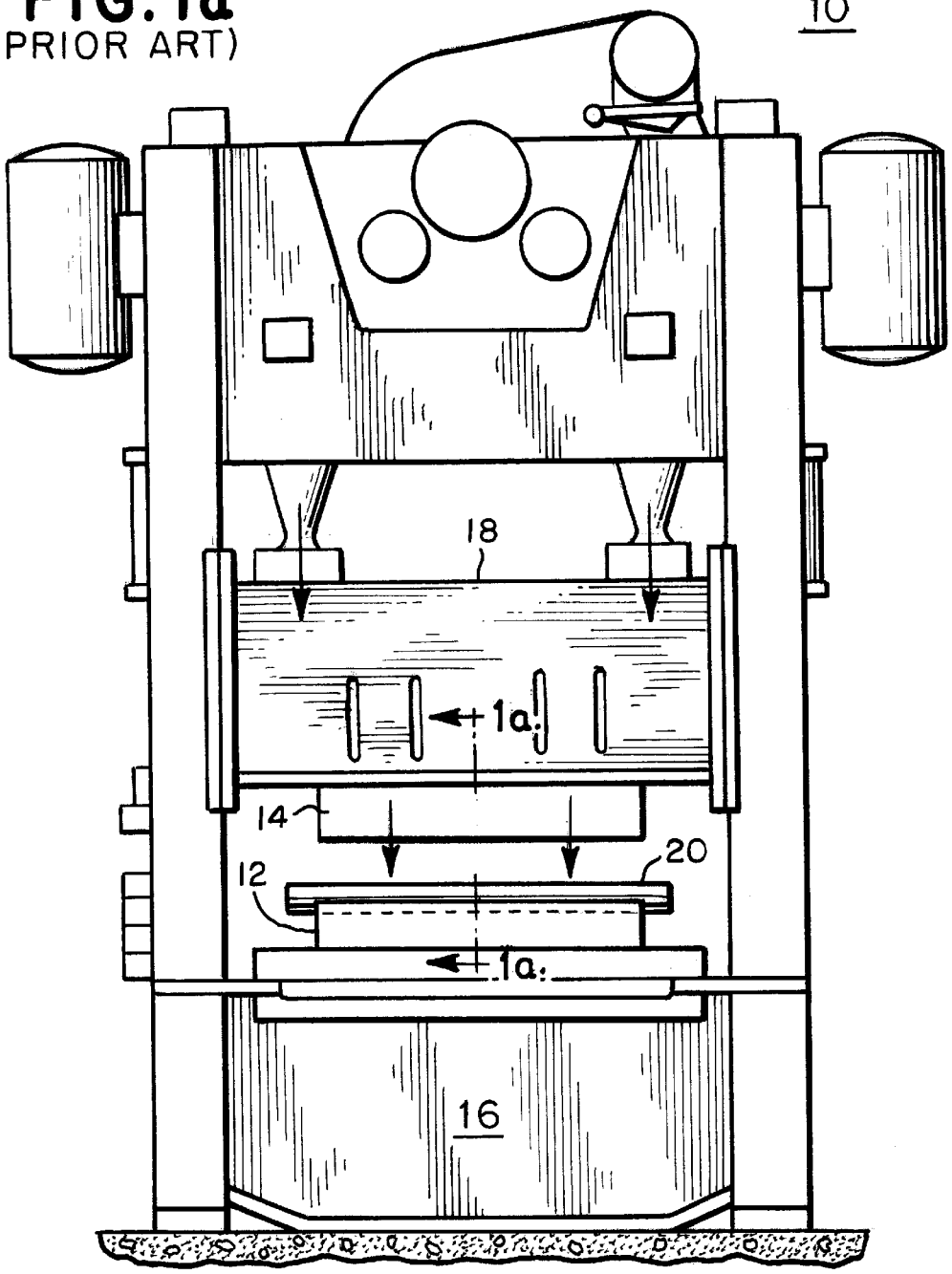
FIG. 1a (PRIOR ART)
FIG. 1*a* is a side elevation view of a standard mechanical press in an open position.

While the invention is susceptive to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invent ion as defined by the appended claims.

DETAILED DESCRIPTION OF THE INVENTION

Surprisingly, it has been discovered that a standard mechanical press can be efficiently transformed into a hydroforming apparatus in accordance with the present invention. The hydroforming apparatus and method of the present invention have been found to adapt a standard mechanical press into an apparatus that can create complex-shaped frame members from blank tubes. By mounting the lower die on a moveable bolster plate instead of a fixed die bed, the lower die can be mated with the upper die regardless of the stopping tolerance of the mechanical press. By lifted the lower die on the bolster plate the distance separating the two dies, the lower and upper die cavities always join to form a forming cavity. Moreover, the hydroforming apparatus and method can be efficiently and inexpensively operated and maintained to create complex-shaped frame members.

The hydroforming apparatus and method of the present invention transforms a standard mechanical press into an apparatus that forms complex-shaped frame members from a blank tube. The standard elements of the mechanical press include a lower die and an upper die mounted to a ram press. Generally, the lower die is mounted on a fixed die bed. To transform the standard mechanical press into a hydro-tube form mechanical press, the present invention mounts the lower die on a moveable bolster plate that is moved by moving means directed by a controller to move the lower die into mating contact with the upper die. The present invention also incorporates sealing units to seal the opposed ends of a blank tube and to introduce pressurized forming fluid into the tube.

To form a complex-shaped frame member, a blank tube is placed into a lower die cavity in the lower die. The upper die is lowered to a close proximity to the lower die. The upper die cavity of the upper die is aligned with the lower die cavity. At the close proximity point, the upper die cavity does not contact the blank tube. The distance separating the upper die from the lower die is approximately one half of an inch. The upper die could be lowered to contact the tube, but the tube would collapse between the upper and lower die cavities.

The ram press of a mechanical press moves along an elliptical path to lower the upper die. The ram press stops at the one hundred eighty degree point of its path with a tolerance of plus or minus five degrees. The present invention contemplates lowering the upper die to a close proximity to the lower die such that the upper die cavity does not contact the tube. To prevent the upper die from collapsing the tube, the ram press can be adjusted to stop without the upper die contacting the tube, or the lower die may be adjusted to a lower position than on a standard mechanical press such that the upper die does not contact the tube when fully lowered.

With the upper die at the close proximity point, the sealing units move from a retracted position to a sealed position. In the retracted position, the sealing units are positioned away from the ends of the tube. In the sealed position, the sealing units sealably engage the ends of the tube providing a tight fluid seal. Any type of sealing unit that provides a tight fluid seal may be used in the present invention.

Once the sealing units are in the sealed position, the sealing units introduce a forming fluid into the tube. To prevent the tube from collapsing when the upper die and lower die mate, the pressure of the forming fluid in the tube is increased to a low pressure range. Increasing the pressure of the forming fluid to the low pressure range provides a liquid mandrel to prevent the tube from collapsing. The low pressure range is dependent upon the material of the blank tube. The low pressure range is a range of pressure greater than the pressure which would prevent the tube from collapsing upon itself when the dies mate and less than the yield point pressure which would expand the tube. In normal operation of the present invention, the low pressure range is between 500 to 1200 pounds per square inch.

Once the fluid pressure within the tube is at the low pressure range, the lower die raises to mate with the upper die. When the upper and lower dies mate, the upper and lower die cavities join to form the forming cavity. The forming cavity represents the desired cross-sectional shape of the formed tube.

To raise the lower die to mate with the upper die, the distance separating the lower die and upper die is determined. Any means for determining the distance separating the lower and upper die may be used. One example of a preferred sensor determines the exact position of the upper die, and other sensor determines the exact position of the lower die. An Absocoder VRE series single turn Resolver #VRE-PO62FAC supplied by the NSD Corporation is one example of a preferred sensor to determine the position of the upper die. An Absocoder VLS series linear Resolver #VLS-256PW588 supplied by the NSD Corporation is one example of a preferred sensor to determine the position of the lower die. Using the sensor information, a controller calculates the distance between the two dies and instructs the bolster plate moving means to raise the lower die the distance separating the dies. One example of a preferred controller is an Allen-Bradley Company SLC-5-03 Processor programmed with Allen-Bradley Company 1747 series software. Other methods for determining the distance separating the dies would be to have a sensor directly measure the distance and supply the distance to the controller. Another means for determining the distance would be to have a sensor that determine exactly when the dies mate and stop the bolster plate moving means from further raising the lower die when the dies mate.

To raise the lower die, the bolster plate must be raised from a lowered position to a lifted position. Bolster plate moving means raise and lower the lower die mounted on the bolster plate. Examples of suitable moving means include hydraulic cylinder assemblies and motor and screw combinations. The moving means lifts the bolster plate and supports the downward force of the ram press and pressurized tube. The moving means are selected and arranged to provided the necessary support to the bolster plate.

After the lower and upper dies mate, the pressure in the tube increases to a high pressure range. The high pressure range is a pressure sufficiently high to expand the tube to fill the recesses of the forming cavity which is dependent on the material of the blank tube. The high pressure range is a range of pressure greater than the yield point pressure which would expand the tube into the recesses of the forming cavity and less than the yield point pressure of the dies and sealing units. In normal operation, the high pressure range is between 3000 to 10000 pounds per square inch. The high pressure range extend to a even higher pressure such as 30000 pounds per square inch as long as the sealing units can maintain their seals and the dies are not separated. The high pressure range may be between 3000 to 30000 pounds per square inch.

By increasing the pressure of the forming fluid to the high pressure range, the tube expands into the recesses of the forming cavity. After the tube has been expanded, the pressure on the forming fluid is removed, and the forming fluid is drained from the formed tube. The upper die is raised to allow the formed tube to be removed from the hydroforming press. The formed tube may be remove through the aid of lifters.

The above hydroforming steps may be modified to achieve a similar result. For example, the upper die may be lowered to contact and collapse the tube between the upper die cavity and lower die cavity. If the tube collapses, a higher pressure is required to remove the collapsed portion of the tube and to fill the recesses of the forming cavity. The other steps directed to preventing a tube collapse may be eliminated including the steps of filling the tube with forming fluid prior to mating the dies and the step of increasing the pressure in the tube to a low pressure range prior to mating the dies. Without these steps the tube would collapse between the mating dies requiring higher pressure at later steps to remove the collapse.

DESCRIPTION OF ILLUSTRATIVE EMBODIMENTS

Figure 1B:
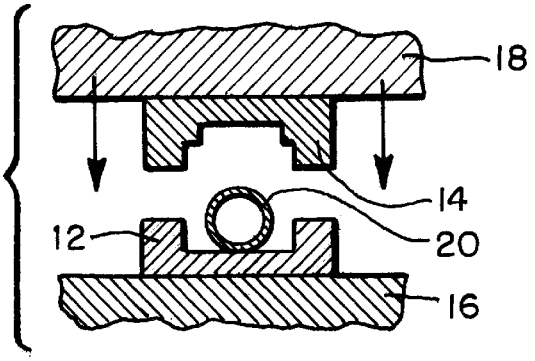
FIG. 1b (PRIOR ART)
FIG. 1*b* is an end view of the mechanical press of FIG. 1*a* along line 1*a*—1*a*.

Turning now to the drawings, the FIGS. 2*a*, 2*b*, 2*c*, 3*a*, 3*b*, 4, 5 and 6 illustrate the currently preferred embodiment of a hydro-tube form mechanical press 30. The hydro-tube form mechanical press 30 of FIG. 2*a* contains similar elements as the standard mechanical press of FIGS. 1*a* & 1*b*, including the ram press 18, upper die 14 and lower die 12. However, hydro-tube form mechanical press 30 implements a hydroforming process to shape a blank tube 20 into a complex tubular shape. In general, the hydroforming process requires a blank tube to be encased in the forming cavity between two merged dies. The ends of the blank tube are sealed, and the blank tube is filled with pressurized forming fluid to expand the blank tube into recesses of the forming cavity creating the complex tubular shape conforming to the forming cavity.

Figure 2A:
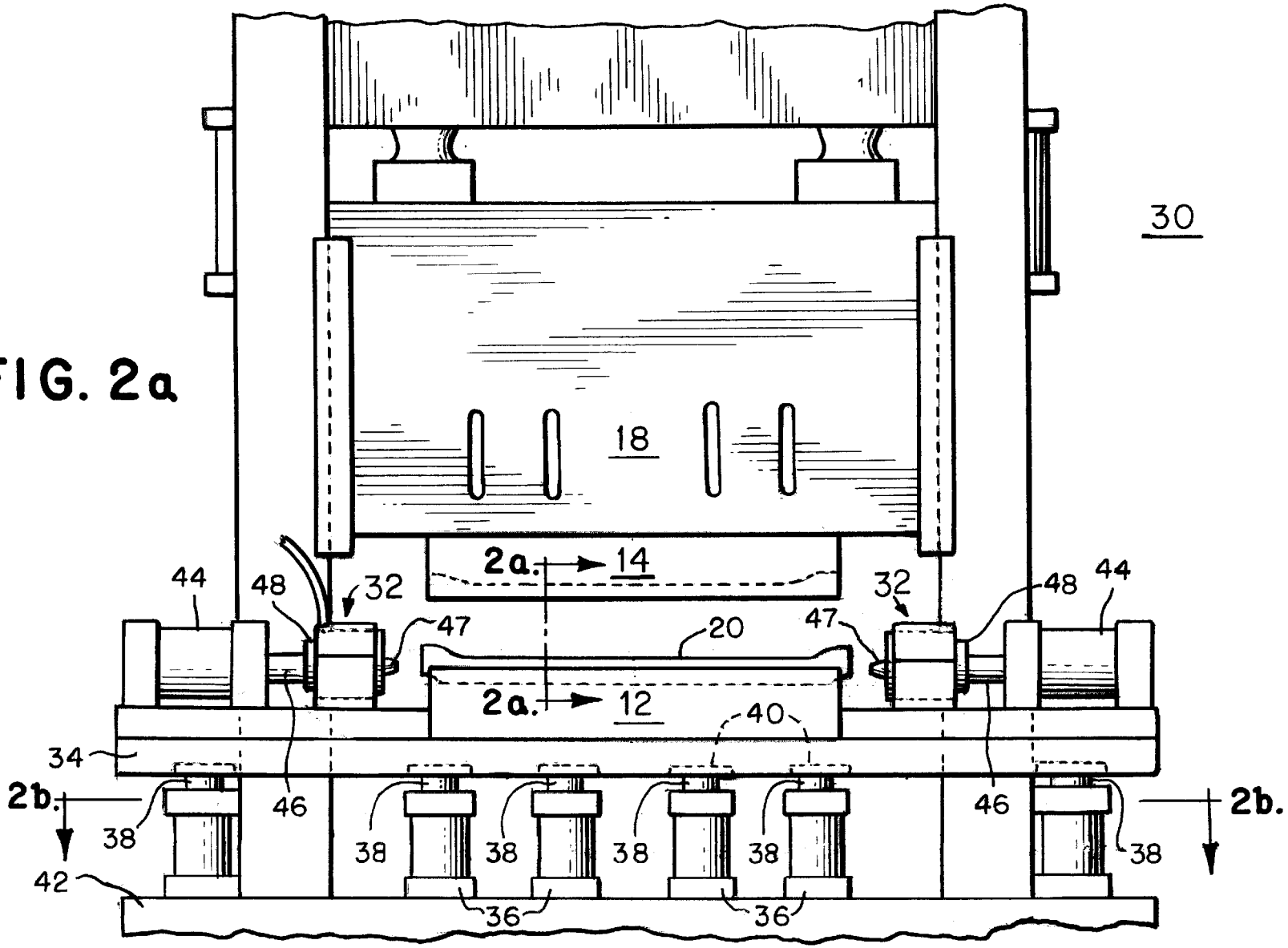
FIG. 2*a* is a side elevation view of a preferred embodiment of the hydro-tube form die mechanical press in an open position.
Figure 2B:
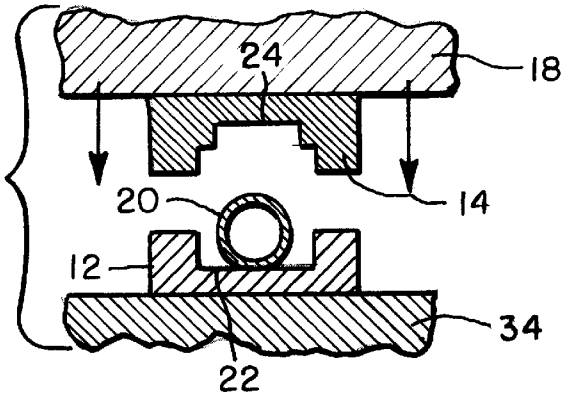
FIG. 2*b* is an end view of the press of FIG. 2*a* along line 2*a*—2*a*.

FIG. 2*a* illustrates the starting position for the hydro-tube form mechanical press 30. The upper die 14 and the ram press 18 occupy a open position raised above the lower die 12. In the press' starting position, a blank tube is loaded onto a cavity 22 in the lower die 12 as shown in FIG. 2*b*. When loading the blank tube 20, an electronic device known in the art can read the weld seam on the blank tube 20 and appropriately position the seam within the cavity 22. In the press start position, a pair of sealing units 32 are in a retracted position away from the opposed ends of the tube 20, and the lower die 12 is in a lowered position. The lower die 12 is mounted on a bolster plate 34. A plurality of lifting cylinder assemblies 36 support the bolster plate 34 with piston rods 38. The connecting plate 40 connects the piston rods 38 to the bolster plate 34. The lifting cylinder assemblies 36 rest on a floor or a fixed bed 42.

Figure 2C:
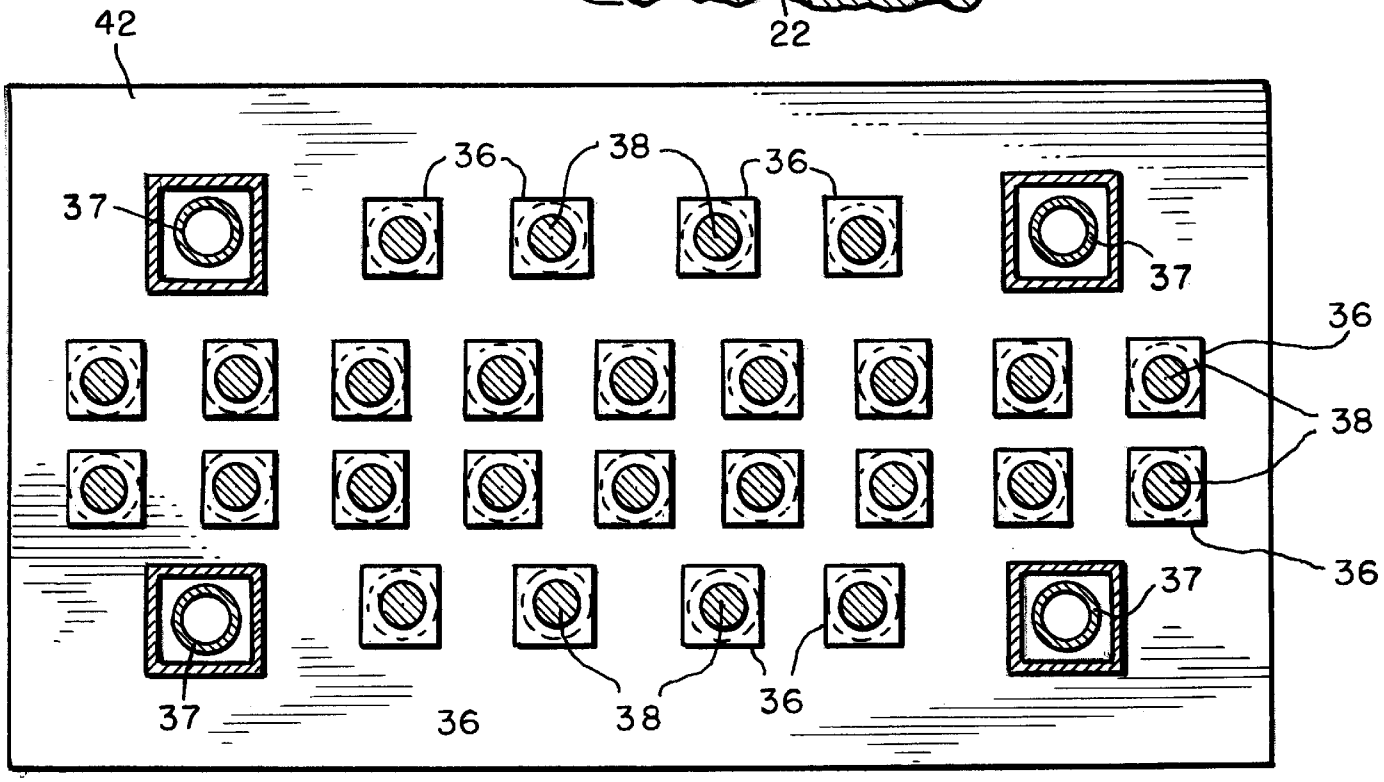
FIG. 2*c* is a bottom view of a embodiment of the press of FIG. 2*a* along line 2*b*—2*b*.

FIG. 2*c* illustrates the arrangement of the lifting cylinder assemblies 36. In the preferred embodiment, twenty-six lifting cylinders support the bolster plate 34 and the lower die 12. The lifting cylinder assemblies 36 have a six inch bore and three inch stroke. The lifting cylinder assemblies 36 provide the necessary force to raise the lower die 12 from the lowered position to a lifted position. In the lifted position, the lower die 12 mates the upper die 14 in the close proximity position. The lifting cylinder assemblies 36 also provide enough force to maintain the lower die 14 in the lifted position when the forming fluid is highly pressurized in the tube 20. The embodiment illustrated in FIG. 2*c* supports an eight hundred fifty ton ram press in addition to the forming pressure against the lower die 12. The lifting cylinder assemblies 36 may be sized, arranged and numbered to support any range of ram presses and hydroforming pressures. A conventional hydraulic line (not shown) supplies hydraulic pressure to the lifting cylinders 36 to move the piston arms 38. FIG. 2*c* also illustrates four guide pins 37 located at the four comers of the bolster plate 34. The guide pins 37 guide the lifting and lowering of the bolster plate 34.

To activate the hydro-tube form mechanical press 30, an operator presses a start button (see FIG. 5) to initiate the hydro-tube form process. The control system for the hydro-tube form mechanical press 30 will be described in detail below. Once the start button has been pressed, the ram press 18 lowers the upper die 14 to the close proximity with the lower die 12. The upper die 14 has a cavity 24 aligned with the lower die cavity 22 (see FIG. 2*b*). The ram press 18, moving the upper die 14 downward, follows an elliptical path starting at zero degrees. Ideally, the ram press 22 stops at an one hundred and eighty degree point; however, the typical ram press 18 has a stopping tolerance of plus or minus five degrees. In the preferred embodiment, the ram press 18 is adjusted such that at its one hundred and eighty degree point approximately one half of an inch separates the upper die 14 from the lower die 12. When the ram press 18 stops and the upper die 14 is in close proximity to the lower die 12, typically, approximately one half of an inch separates the two dies 12 and 14. The ram press is adjusted to prevent the upper die cavity 24 from contacting the tube 20. In other embodiments, the ram press 18 may lower the upper die 14 far enough to collapse the tube between the upper and lower die cavities 24 and 22.

After the upper die 14 is in the close proximity with the lower die 12 as shown in FIG. 3, the sealing units 32 advance to a sealed position. In the sealed position, the sealing units 32 sealably engage the ends of the blank tube 20. Sealing cylinder assemblies 44 move the sealing units 32 from the retracted position to the sealed position. In the sealed position, the sealing units provide a tight fluid seal on the ends of the blank tube 20. The sealing unit 32 may be any type of sealing device which seals the ends of the tube 20.

Figure 3A:
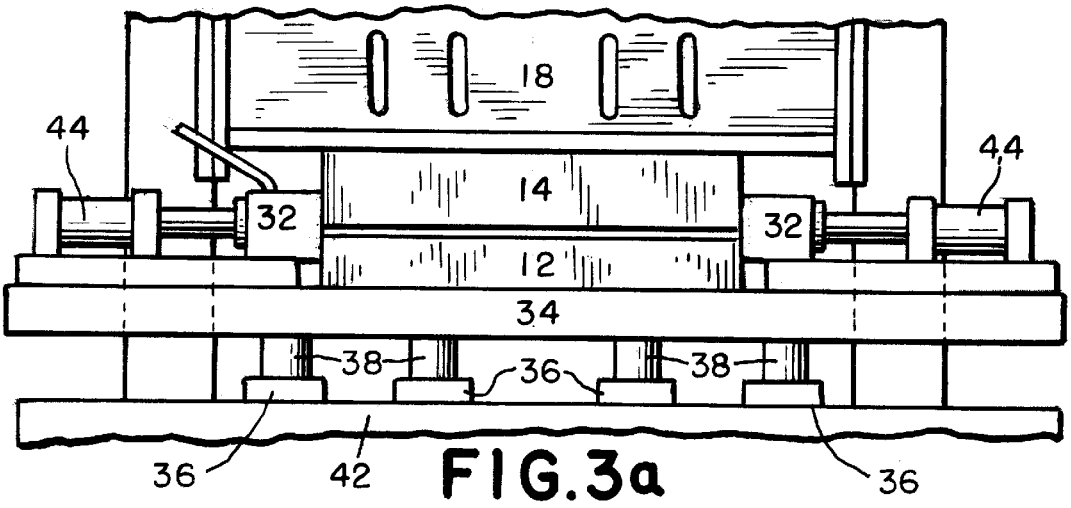
FIG. 3*a* is a side elevation view of the press of FIG. 2*a* with the upper die in a close proximity to the lower die.
Figure 3B:
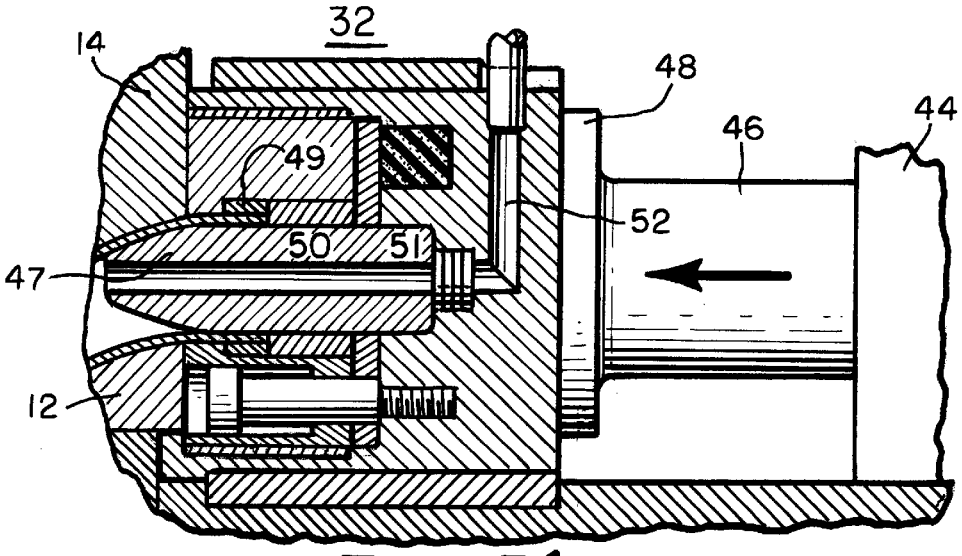
FIG. 3*b* is a side elevation view of the sealing unit in FIG. 3*a*.

FIG. 3*b* illustrates the currently preferred sealing unit for the hydro-tube form mechanical press 30. This sealing unit is similar to the sealing unit shown and described in detail in co-pending application entitled "Sealing Unit for Hydroforming Apparatus" by inventor James F. Brown filed on May 15, 1997. The sealing unit 32 in FIG. 3*b* comprising a tapered element 50 and a sealing ring 49. The tapered element 50 has an insertion end 47 with an outer diameter smaller than the inner diameter of the tube 20 and a housing end 51 with an outer diameter greater than the inner diameter of the tube 20. The sealing ring 49 has an uniform inner diameter equal to or slightly larger than the outer diameter of the tube 20. When the sealing unit 32 is in the sealed position as shown in FIG. 3*b*, the tapered element 50 is in sealable engagement with the inner wall of the tube 20 to provide a tight fluid seal between the tapered element 50 and the inner wall of the tube 20. When the tapered element engages the inner wall of the tube, the tapered element pushes the wall of the tube 20 outward against the sealing ring 49 to provide a tight fluid seal between the sealing ring 49 and the tube 20. To move the sealing unit 32, the sealing cylinder assemblies 44 have an outwardly extending piston rod 46 which connects to the sealing unit 32 at a connecting plate 48. A conventional hydraulic line (not shown) supplies hydraulic pressure to the sealing cylinder assembly 44 to move the piston arm 46.

After the sealing units 32 are in the sealed position as illustrate in FIG. 3, the fluid control means or intensifier 56 (see FIG. 4) fills the tube 20 with the forming fluid. The forming fluid is 95% water and 5% water additives including a lubricant, a cleaning agent and a rust inhibitor. A fluid supply chamber 54 (see FIG. 4) supplies the forming fluid to the tube 20 through a central fluid passage 52. After the tube 20 is full, an intensifier 56 (see FIG. 4) advances the fluid pressure within the tube 20 to a low pressure range to provide a liquid mandrel to prevent the tube from collapsing when the upper and lower die mate. The low pressure range is dependent on the material and thickness of the tube 20. The low pressure range is a range of pressure greater than the pressure which would prevent the tube from collapsing upon itself when the die mate and less than the yield point pressure which would expand the tube. In normal operation, the low range of pressure is between 500 and 1200 pounds per square inch.

In the preferred embodiment, the pressure of forming fluid in the tube 20 advances to a low level before joining the upper die cavity 24 and the lower die cavity 22 to prevent the tube 20 from collapsing. Other embodiments are possible such as filling and pressurizing the tube 20 after the joining the cavities 22 and 24. In the preferred embodiment, the low pressure forming fluid in the tube 20 forms a liquid mandrel supporting the inner wall of the tube 20. Because of the liquid mandrel, the tube 20 does not collapse when the cavities 22 and 24 are joined. If the dies 12 and 14 are joined prior to filling the tube 20, the tube 20 collapses requiring a significantly greater internal fluid pressure to expand the tube 20 into the recesses of the forming cavity.

Figure 4:
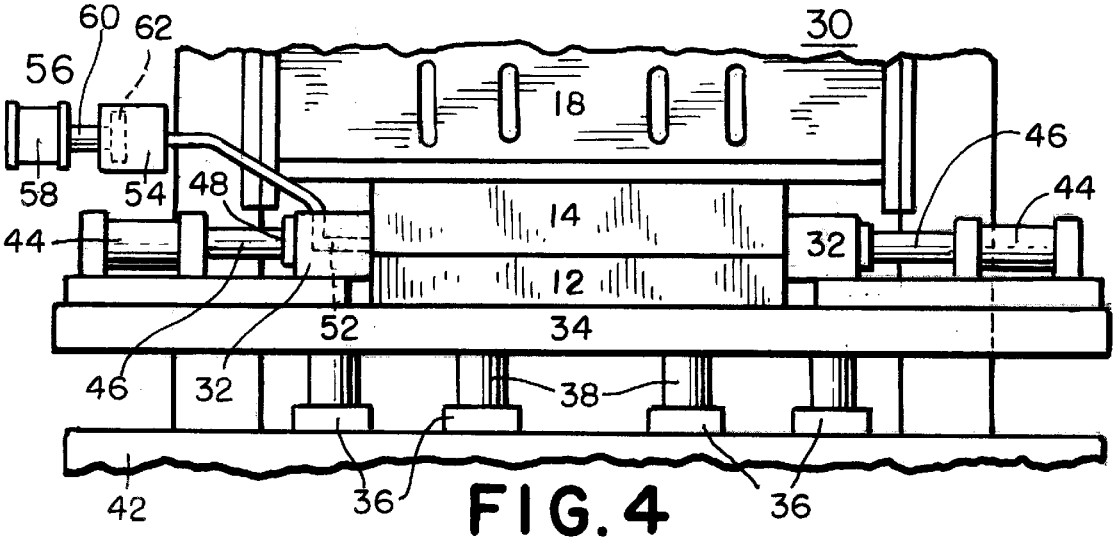
FIG. 4 is a side elevation view of press of FIG. 2*a* with the lower die in a lifted position.

After the fluid pressure in the tube 20 is at a low level, the lifting cylinders 36 raise the bolster plate 34 and lower die 12 to the lifted position merging the lower die cavity 22 with the upper die cavity 24 into the forming cavity. The lifting cylinders 36 raise the bolster plate 34 a distance necessary to join the lower and upper dies 12 and 14 as shown in FIG. 4. Considering the tolerance associated with the stopping of the ram press 18, a controller 70 (see FIG. 5) determines the exact position of the upper die 14. Using the position of the upper die 14, the controller 70 determines the distance that the lower die 14 needs to be raised. The controller 70 and its function are described in detail below. The controller 70 instructs the lifting cylinder assemblies 36 to extend their piston arms 38 the determined distance to merge the two die cavities 22 and 24.

After the upper and lower dies 14 and 12 mate as illustrated in FIG. 4, the intensifier 56 raises the internal pressure in the tube 20 to a high pressure range. The high range of pressure is a range of pressure dependent on the material and thickness of the tube 20. The high pressure range is a range of pressure greater than the yield point pressure which would expand the tube into the recesses of the forming cavity and less than the yield point pressure of the dies and sealing units to prevent them from being deformed. Simply, the high pressure range must be sufficient to expand the tube 20 into the corners of the forming cavity. Typically, the range of pressure is between 3000 and 10000 pounds per square inch.

FIG. 4 illustrates the intensifier 56. The intensifier has a pushing cylinder 58 with a piston rod 60 connected to a supply plate 62. To increase the fluid pressure in the tube 20, the intensifier 56 extends its piston arm 60 moving the supply plate 62 to decrease the volume of the fluid supply chamber 54. Decreasing the volume of the fluid supply chamber 54 increases the pressure of the forming fluid in the tube 20. High internal pressure in the tube 20 forces the tube walls to expand into the recesses of the forming cavity. After the high pressure is reached, the intensifier stops compressing the volume of fluid supply chamber 54.

Once the tube 20 fills the forming cavity, the intensifier 56 retracts its piston arm 60 returning the forming fluid to the fluid supply chamber 54. The forming fluid drains from the tube 20, and the sealing units 32 retract to the retracted position. The lifting cylinder assemblies 36 lower the bolster plate 34 and lower die 12 to the lowered position, and the ram press 18 and upper die 14 move to the open position. The finished formed tube may be removed from the lower die cavity 22, and the process may be restarted by an operator. A lifter (not shown) known in the art may aid in removing the formed tube from the lower die cavity 22.

Figure 5:
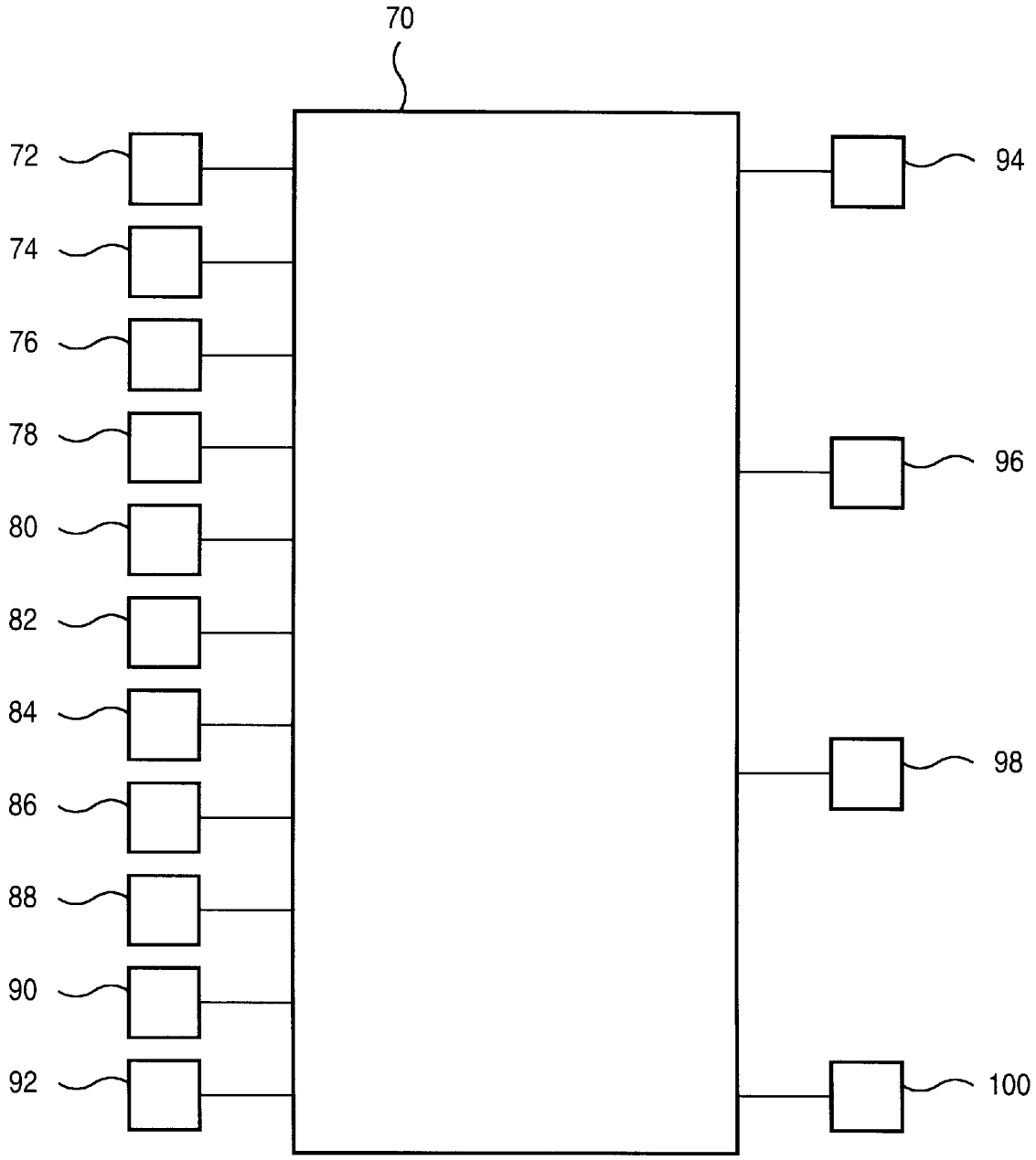
FIG. 5 is block diagram of the preferred embodiment for the controller.

A controller 70 controls the operation of the hydro-tube form mechanical press 30. FIG. 5 illustrates a block diagram of the inputs to the controller 70 and outputs from the controller 70 for the preferred embodiment. The controller 70 may be any type of control circuit or microprocessor. In the preferred embodiment, an Allen-Bradley Company SLC-5-03 Processor is programmed with Allen-Bradley Company 1747 series software to control the hydroforming process of the press 30.

The controller 70 has multiple inputs receiving information from peripheral devices. A start button 72 provides a signal to start the hydroforming process. The start button 72 may be a simple palm button or a complex operator interface. A ram press position sensor 74 provides data representing the position of the ram press 18 at its close proximity to the lower die 12. In the preferred embodiment, the ram press position sensor 74 is an Absocoder VRE series single turn Resolver #VRE-PO62FAC supplied by the NSD Corporation. The Resolver provides a signal representing the angular position of the ram press 18 to the controller 70. The controller 70 uses angular position data to determine the distance separating the upper die 14 from the lower die 12. A bolster plate position sensor 76 provides data representing the position of the bolster plate 34. In the preferred embodiment, the bolster plate sensor 76 is a Absocoder VLS series linear Resolver #VLS-256PW588 supplied by the NSD Corporation. In the preferred embodiment, two bolster plate position sensors 76 are positioned at opposite corners of the bolster plate 34 to ensure the bolster plate 34 is level.

Other inputs to the controller 70 include a intensifier pressure sensor 78 which provides data representing the fluid pressure at the pushing cylinder 58, and a forming fluid pressure sensor 80 which provides data representing the fluid pressure in the tube 20. The controller 70 uses the data from the pressure sensor inputs 78, 80 to control the fluid pressure in the tube 20. A lifting cylinder pressure sensor 82 provides data representing the fluid pressure at the lifting cylinder 36, and a sealing cylinder pressure sensor 84 provides data representing the fluid pressure in the sealing cylinder 44. The controller 70 uses the data from the pressure sensor inputs 82 and 84 to control the motion of the sealing units 32 between the retracted position and sealed position and to control the motion of the lower die 12 between the lowered position and lifted position. In the preferred embodiment, the pressure sensors 78, 80, 82 and 84 are pressure transducers. A flow switch 86 also provides data to the controller 70 representing that forming fluid is flowing into the tube 20. A bolster plate proximity switch 88 signals the controller 70 whether the bolster plate 34 is in the lowered position or lifted position. A sealing unit proximity switch 90 signals the controller 70 whether the sealing unit 32 is in the retracted position or sealed position. A tube present proximity switch 92 signals the controller 70 whether a blank tube 20 is present in the lower die 12 or no tube 20 is present in the lower die 12.

FIG. 5 illustrates the plurality of outputs from the controller 70 which control the operation of the hydro-tube form press. The controller 70 provides a signal to a ram press control 94 directing the ram press 18 to move the upper die 14 between the close proximity position and the open position. The controller 70 also sends a signal to sealing valve solenoid 96 to control the hydraulic valves of the sealing cylinders 44 directing the sealing units to the retracted position or sealed position. The controller 70 also sends a signal to the lifting valve solenoid 98 of the lifting cylinders 36 directing the bolster plate 34 to the lowered position or the lifted position. Another output signals the intensifier solenoid valve 100 to control the forming fluid pressure within the tube 20.

Figure 6A:
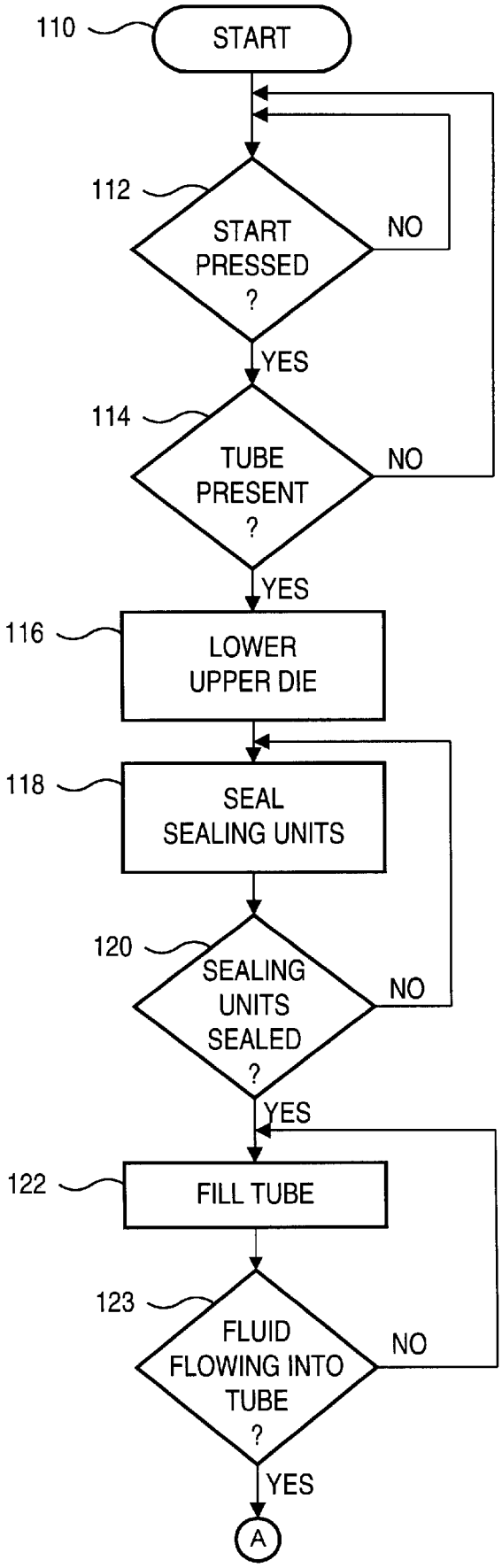
FIG. 6 is a flow chart of the preferred embodiment for the program of the controller.
Figure 6B:
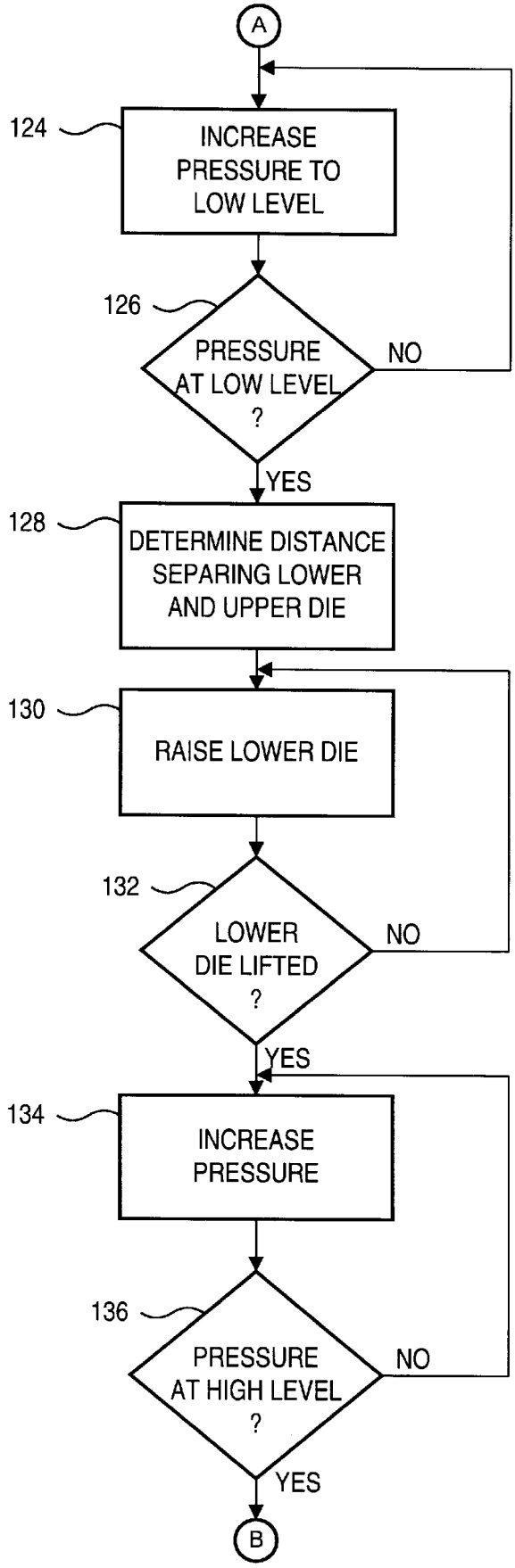
Figure 6C:
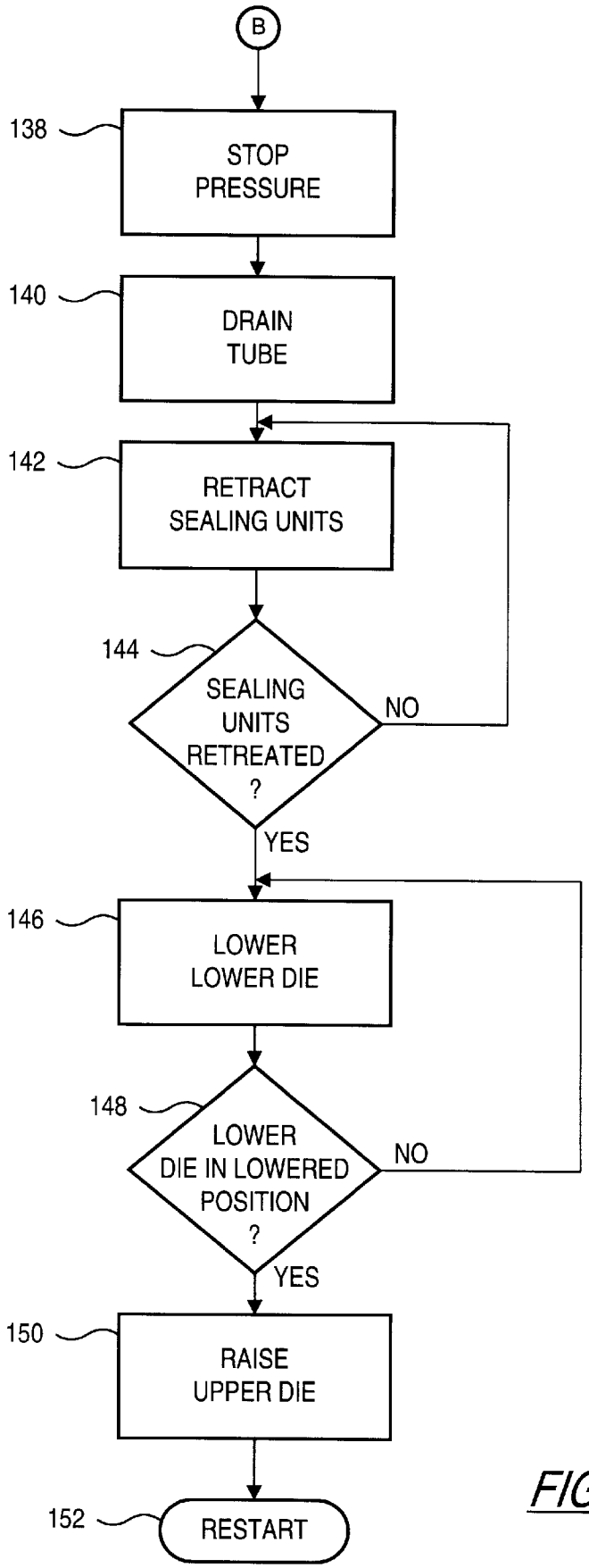

FIG. 6 is a flow chart outlining the preferred embodiment for the operation of the programmed controller 70. The program begins at step 112, the controller 70 determines whether the start button 72 has been pressed. If the answer at step 112 is negative, the controller 70 returns to step 110. If the answer at step 112 is affirmative, the controller 70 determines whether a tube 20 is present in the lower die cavity 22 by reading the tube present proximity switch 92 at step 114. If the answer at step 114 is negative the controller 70 returns to step 112. If the answer at step 114 is affirmative, the controller 70 directs the ram press control 94 to lower the upper die 14 on the ram press 18 to the close proximity position at step 116. At step 118, the controller 70 activates the sealing valve solenoid 96 to move the sealing units 32 from a retracted position to the sealed position. At step 120, the controller 70 determines whether the sealing units are in the sealed position by reading the sealing unit proximity switch 90. If the answer at step 120 is negative, the controller returns to step 118 to move the sealing units 32 to the sealed position. If the answer at step 120 is affirmative, the controller fills the tube 20 with the forming fluid by signaling the intensifier valve solenoid 100 at step 122. At step 123, the controller determines whether forming fluid is flowing into the tube 20 by reading the flow switch 86. If the answer at step 123 is negative, the controller returns to step 122. If the answer at step 123 is affirmative, the controller 70 further signals the intensifier valve solenoid 100 to increase the fluid pressure within the tube 20. At step 126, the controller 70 determines whether the fluid pressure in the tube 20 is at a low pressure range by reading the forming fluid pressure sensor 80. If the answer at step 126 is negative, the controller returns to step 124. If the answer at step 126 is affirmative, the controller 70 reads the upper die position from the ram press position sensor 74 and the lower die position from the lower die position sensor 76. Using the upper and lower die positions, the controller 70 calculates the distance the lower die must be raised to join the lower and upper dies 12 and 14 at step 128. At step 130, the controller instructs the lifting valve solenoid 98 to raise the lower die 12 the calculated distance. At step 132, the controller 70 determines whether the lower die 12 is in the lifted position by reading the bolster plate proximity switch 88. If the answer at step 132 is negative, the controller returns to step 130. If the answer at step 132 is affirmative, the controller signals the intensifier valve solenoid 100 to increase the fluid pressure in the tube 20 at step 134. At step 136, the controller 70 determines whether the fluid pressure in the tube 20 is at a high pressure range by reading the forming fluid pressure sensor 80. If the answer at step 136 is negative, the controller returns to step 134. If the answer to step 136 is affirmative, the controller stops increasing the fluid pressure by signaling the intensifier valve solenoid 100 at step 138.

After a set time interval, one example of a preferred time interval is one second, to allow the tube 20 to expand in the forming cavity, the controller instructs the fluid to be drained from the tube by signaling the intensifier valve solenoid 100 at step 140. At step 14, the controller 70 instructs the sealing valve solenoid 96 to retract the sealing units to the retracted position. At step 144, the controller 70 determines whether the sealing units 32 are in the retracted position by checking the sealing unit proximity switch 90. If the answer at step 144 is negative, the controller returns to step 142. If the answer at step 144 is affirmative, the controller 70 instructs the lifting valve solenoid 98 to lower the lower die 12 to the lowered position at step 146. At step 148, the controller determines whether the lower die 12 is in the lowered position by checking the bolster plate proximity switch 88. If the answer at step 148 is negative, the controller 70 returns to step 146. If the answer to step 148 is affirmative, signals the ram press control 94 to raise the upper die 14 at step 150. At step 152, the controller 70 restarts the program waiting for the start button to be pressed.

While particular embodiments and applications of the present invention have been illustrated and described, it is to be understood that the invention is not limited to the precise construction and compositions disclosed herein and that various modifications, changes, and variations will be apparent from the foregoing descriptions without departing from the spirit and scope of the invention as defined in the appended claims.

What is claimed is:

1. A method for forming a complex-shaped frame member from a blank tube having opposed ends comprising the steps of:

placing said blank tube into a first cavity in a lower die;

lowering, along an elliptical path, an upper die from an open position to a close proximity to said lower die, said upper die having a second cavity aligned with said first cavity;

sealing said opposed ends of said blank tube; then introducing a forming fluid into said sealed tube;

after the lowering step determining a distance separating said upper die from said lower die; then raising said lower die said determined distance such that said upper die and said lower die mate joining said second cavity and said first cavity into a forming cavity; and then pressurizing said forming fluid in said sealed tube to a pressure sufficient to expand said tube so that it conforms to said forming cavity, while maintaining said upper die in a mating position with said lower die.

2. The method of claim 1 wherein said pressure to expand said tube is in a pressure range above a yield point of said tube and below a pressure at which said upper die and said lower die separate.

3. The method of claim 1 wherein said pressure to expand said tube is a pressure range of 3,000 to 10,000 pounds per square inch.

4. The method of claim 1 further comprising, after the step of introducing, the step of pressurizing said forming fluid in said blank tube to a pressure in a range between a pressure above a tube collapsing point when said lower die and upper die mate and a pressure below a yield point of said tube.

5. The method of claim 4 wherein said pressure in said range between said pressure above said tube collapsing point when said lower die and said upper die mate and said pressure below said yield point of said tube is a pressure range of 500 to 1,200 pounds per square inch.

6. The apparatus of claim 4 wherein the forming liquid comprises water.

7. The apparatus of claim 4 wherein the forming liquid comprises water, a lubricant, a cleaning agent and a rust inhibitor.

8. The method of claim 1 wherein said close proximity is approximately one half of an inch separating said lower die from said upper die.

9. The method of claim 1 wherein said close proximity is such that said upper die cavity does not contact said tube.

10. The method of claim 1 wherein the step of placing precedes the step of lowering.

11. The method of claim 1 wherein the pressure sufficient to expand said tube is in the range between 3,000 to 30,000 pounds per square inch.

12. The method of claim 1 wherein the tube is made of metal and the forming fluid is a liquid.

13. The method of claim 1 wherein the forming fluid comprises water.

14. The method of claim 1 wherein the forming fluid comprises water, a lubricant, a cleaning agent and a rust inhibitor.

15. The method of claim 1 wherein the forming fluid comprises 95 weight percent water and 5 percent additives, said additives comprise a lubricant, a cleaning agent an a rust inhibitor.

16. A method for forming a complex-shaped frame member from a blank tube having opposed ends comprising the steps of:

placing said blank tube into a first cavity in a lower die;

lowering along an elliptical path an upper die from an open position to a close proximity to said lower die, said upper die having a second cavity aligned with said first cavity;

sealing said opposed ends of said blank tube;

raising said lower die such that said upper die and said lower die mate joining said second cavity and said first cavity into a forming cavity; then filling said tube with a forming fluid; and then pressurizing said forming fluid in said sealed tube to a pressure sufficient to expand said tube so that it conforms to said forming cavity, while maintaining said upper die in mating position with said lower die.

17. The method of claim 16 wherein said pressure to expand said tube is in a pressure range above a yield point of said tube and below a pressure at which said upper die and said lower die separate.

18. The method of claim 16 wherein said pressure to expand said tube is a pressure range of 3,000 to 10,000 pounds per square inch.

19. The method of claim 16 wherein said close proximity is approximately one half of an inch separating said lower die from said upper die.

20. The method of claim 16 wherein said close proximity is such that said upper die cavity does not contact said tube.

21. The method of claim 16 wherein the pressure sufficient to expand said tube is in the range between 3,000 to 30,000 pounds per square inch.

22. The method of claim 16 wherein the tube is made of metal and the forming fluid is a liquid.

23. The method of claim 16 wherein the forming fluid comprises water.

24. The method of claim 16 wherein the forming fluid comprises water, a lubricant, a cleaning agent and a rust inhibitor.

25. The method of claim 16 wherein the forming fluid comprises 95 weight percent water and 5 percent additives, said additives comprise a lubricant, a cleaning agent an a rust inhibitor.

26. A method for forming a complex-shaped frame member from a blank tube having opposed ends comprising the steps of:

placing said blank tube into a first cavity in a lower die; then, lowering, alone an elliptical path, an upper die from an open position to a close proximity to said lower die so as to produce a gap between said upper die and said lower die, said upper die having a second cavity aligned with said first cavity;

sealing said opposed ends of said blank tube; then filling said sealed tube with a forming fluid;

after the lowering step, measuring the distance separating said upper die from said lower die;

using hydraulic pressure to linearly raise said lower die said measured distance such that said upper die and said lower die are in close contact joining said second cavity and said first cavity into a forming cavity; and pressurizing said forming fluid in said sealed tube to a pressure sufficient to expand said tube so that it conforms to said forming cavity while using hydraulic pressure to maintain said upper die in close contact with said lower die.

27. The method of claim 26 wherein said pressure to expand said tube is in a pressure range above a yield point of said tube and below a pressure at which said upper die and said lower die separate.

28. The method of claim 26 wherein said pressure to expand said tube is a pressure range of 3,000 to 10,0000 pounds per square inch.

29. The method of claim 26 wherein said close proximity is approximately one half of an inch separating said lower die from said upper die.

30. The method of claim 26 wherein said close proximity is such that said upper die cavity does not contact said tube.

31. The method of claim 26 wherein the pressure sufficient to expand said tube is in the range between 3,000 to 30,000 pounds per square inch.

32. The method of claim 26 wherein the tube is made of metal and the forming fluid is a liquid.

33. The method of claim 26 wherein the forming fluid comprises water.

34. The method of claim 26 wherein the forming fluid comprises water, a lubricant, a cleaning agent and a rust inhibitor.

35. The method of claim 26 wherein the forming fluid comprises 95 weight percent water and 5 percent additives, said additives comprise a lubricant, a cleaning agent an a rust inhibitor.

36. An apparatus for forming a complex-shaped frame member from a blank tube having opposed ends comprising:

a lower die capable of moving between an lowered position and a lifted position, said lower die having a first cavity capable of receiving said blank tube;

an upper die capable of moving between an open position and a close proximity to said lower die, said upper die having a second cavity aligned with said first cavity;

a pair of sealing units capable of moving between a retracted position and a sealed position, said sealing units being positioned away from said opposed ends of said tube in said retracted position, said sealing units sealably engaging said opposed ends of said tube in said sealed position, a fluid delivery means for communicating a forming fluid to said tube;

a position determining means for determining a distance separating said upper die in said close proximity to said lower die in said lowered position;

a lower die lifting means for raising said lower die from said lowered position said determined distance to said lifted position, when said upper die is in said close proximity to said lower die and said lower die is in said lifted position, said first die and said second die mate joining said first cavity and said second cavity join to form a forming cavity; and a fluid control means for pressurizing said forming fluid in said tube to expand said tube so that it conforms to said forming cavity.

37. The apparatus of claim 36 wherein said pressure to expand said tube is in a pressure range above a yield point of said tube and below a pressure at which said upper die and said lower die separate.

38. The apparatus of claim 36 wherein said pressure to expand said tube is a pressure range of 3,000 to 10,000 pounds per square inch.

39. The apparatus of claim 36 wherein said lower die lifting means comprises at least one hydraulic cylinder adapted to move said lower die between said lowered position and said lifted position.

40. The apparatus of claim 26 wherein said lower die lifting means further comprises a bolster plate, said lower die being mounted on said bolster plate and said hydraulic cylinder connected to said bolster plate, said hydraulic cylinder moving said bolster plate to move said lower die between said lower position and said lifted position.

41. The apparatus of claim 26 wherein said position determining means comprises an upper die position sensor and a controller circuit, said upper die position sensor supplying an upper die position signal to said controller circuit, said controller circuit analyzing said upper die position signal to determine said determined distance, said controller circuit adapted to instruct said lower die lifting means to raise said lower die said determined distance from said lowered position to said lifted position.

42. The apparatus of claim 41 wherein said position determining means further comprises a lower die position sensor, said lower die position sensor supplying a lower die position signal to said controller circuit, said controller circuit analyzing said lower die position signal to determine said determined distance.

43. The apparatus of claim 26 wherein when said upper die is in said close proximity to said lower die and said sealing units are in said seal position and said lower die is in said lowered position, said fluid control means pressurizing said forming fluid in said tube to a pressure in a range between a pressure above a tube collapsing point when said lower die and upper die mate and a pressure below a yield point of said tube, said fluid control means pressurizing said forming fluid in said tube to a pressure range above a yield point of said tube and below a yield point of said upper die and of said lower die to expand said tube such that it conforms to said forming cavity when said upper die is in said close proximity, said sealing units are in said seal position and said lower die is in said lifted position.

44. The apparatus of claim 36 wherein the upper die moves between an open position and a close proximity to said lower die along an elliptical path.

45. An improved mechanical press for shaping a blank tube with opposed ends, said mechanical press of the type containing a lower die having a first cavity capable of receiving a blank tube, a ram press, an upper die mounted on said ram press, said upper die moveable between an open position and a close proximity to said lower die, said upper die having a second cavity aligned with said first cavity, wherein the improvement comprises:

a pair of sealing units moveable between a retracted position and a sealed position, said sealing units being positioned away from said ends of said tube in said retracted position, said sealing units sealably engaging said ends of said tube in said sealed position;

a fluid delivery means for communicating a forming fluid into said tube;

a position determining means for determining a distance separating said upper die in said position from said lower die;

a lower die lifting means capable of raising said lower die said determined distance to join said first cavity and said second cavity to form a forming cavity; and a fluid control means for pressurizing said fluid in said tube to expand said tube such that it conforms to said forming cavity.

46. The improved mechanical press of claim 45 wherein said pressure to expand said tube is in a pressure range above a yield point of said tube and below a pressure at which said upper die and said lower die separate.

47. The improved mechanical press of claim 45 wherein said pressure to expand said tube is a pressure range of 3,000 to 10,000 pounds per square inch.

48. The improved mechanical press of claim 45 wherein said improvement further includes an adjustment to said upper die to prevent said upper die cavity from contacting said tube in said close proximity.

49. The improved mechanical press of claim 45 wherein said lower die lifting means comprises at least one hydraulic cylinder adapted to move said lower die between a lowered position and a lifted position, said lower die positioned away from said upper die in said lowered position, said lower die merging with said upper die in said lifted position.

50. The improved mechanical press of claim 49 wherein said lower die lifting means further comprises a bolster plate, said lower die being mounted on said bolster plate and said hydraulic cylinder having piston rod connected to said bolster plate, said hydraulic cylinder moving said bolster plate to place said lower die in said lower position and said lifted position.

51. The improved mechanical press of claim 45 wherein said position determining means comprises an upper die position sensor and a controller circuit, said upper die position sensor supplying an upper die position signal to said controller circuit, said controller circuit analyzing said upper die position signal to determine said determined distance, said controller circuit adapted to instruct said lower die lifting means to raise said lower die said determined distance from said lowered position to said lifted position.

52. The improved mechanical press of the apparatus of claim 45 wherein said position determining means further comprises a lower die position sensor, said lower die position sensor, said lower die position sensor supplying a lower die position signal to said controller circuit, said controller circuit analyzing said lower die position signal to determine said determined distance.

53. The improved mechanical press of claim 45 wherein when said upper die is in said close proximity, said sealing units are in said seal position and said lower die is in said lowered position, said fluid control means pressurizing said fluid in said tube to a pressure in a range between a pressure above a tube collapsing point when said lower die and upper die mate and a pressure below a yield point of said tube, said fluid control means pressurizing said fluid in said tube to a pressure range above a yield point of said tube and below a yield point said upper die and said lower die to expand said tube such that it conforms to said forming cavity when said upper die is in said close proximity, said sealing units are in said seal position and said lower die is in said lifted position.

54. An apparatus for forming a complex-shaped frame member from a blank metal tube having opposed ends comprising:

a lower die capable of moving between a lowered position and a lifted position, said lower die having a first cavity capable of receiving said blank tube;

an upper die capable of moving along an elliptical path between an open position and a close proximity to said lower die, said upper die having a second cavity aligned with said first cavity;

a pair of sealing units capable of moving between a retracted position and a sealed position, said sealing units being positioned away from said opposed ends of said tube in said retracted position, said sealing units sealably engaging said opposed ends of said tube in said sealed position, a fluid delivery system for communicating a forming liquid to said tube;

a controller;

an upper die position sensor capable of supplying an upper die position signal to said controller, said controller circuit analyzing said upper die position signal to determine a distance separating said upper die in said close proximity to said lower die in said lowered position;

a bolster plate and at least one hydraulic cylinder connected to said bolster plate, said hydraulic cylinder capable of raising said bolster plate and said lower die from said lowered position said determined distance to said lifted position, when said upper die is in said close proximity to said lower die and said lower die is in said lifted position, said first die and said second die mate joining said first cavity and said second cavity join to form a forming cavity; and a fluid controller for pressurizing said forming liquid in said tube to expand said tube so that it conforms to said forming cavity.

55. The apparatus of claim 54 wherein the forming liquid comprises 95 weight percent water and 5 percent additives, said additives comprise a lubricant, a cleaning agent an a rust inhibitor.

* * * * *

UNITED STATES PATENT AND TRADEMARK OFFICE

CERTIFICATE OF CORRECTION

PATENT NO. : 6,006,567

DATED : December 28, 1999

INVENTOR(S) : James J. Brown et al.

It is certified that error appears in the above-identified patent and that said Letters Patent is hereby corrected as shown below:

Column 13, line 45: Change "10,0000" to read –10,000—

Item [73]
Cover page: Add --Aquaform Inc., 1280 Doris Road, Auburn Hills, MI--

Signed and Sealed this

Fifteenth Day of August, 2000

*Attest:*

Q. TODD DICKINSON

*Attesting Officer*

*Director of Patents and Trademarks*